US010980384B2

(12) United States Patent
Sijtsma et al.

(10) Patent No.: US 10,980,384 B2
(45) Date of Patent: Apr. 20, 2021

(54) SURFACE CLEANING DEVICE

(71) Applicant: KONINKLIJKE PHILIPS N.V., Eindhoven (NL)

(72) Inventors: Nyckle Owe Sijtsma, Feanwalden (NL); Bastiaan Johannes De Wit, Nuis (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/733,104

(22) PCT Filed: Nov. 15, 2018

(86) PCT No.: PCT/EP2018/081284
§ 371 (c)(1),
(2) Date: May 18, 2020

(87) PCT Pub. No.: WO2019/101607
PCT Pub. Date: May 31, 2019

(65) Prior Publication Data

US 2020/0359869 A1 Nov. 19, 2020

(30) Foreign Application Priority Data

Nov. 22, 2017 (EP) ..... 17203092

(51) Int. Cl.
*A47L 11/24* (2006.01)
*A47L 11/40* (2006.01)
(Continued)

(52) U.S. Cl.
CPC ..... *A47L 11/24* (2013.01); *A47L 11/4041* (2013.01); *A46B 13/001* (2013.01); *A47L 9/0477* (2013.01); *A47L 2201/00* (2013.01)

(58) Field of Classification Search
CPC ..... A47L 11/24; A47L 11/4041; A47L 11/32; A47L 11/33
See application file for complete search history.

(56) References Cited

U.S. PATENT DOCUMENTS 598,602 A * 2/1898 Keesee ..... A47L 11/4041 15/48.1
3,822,433 A * 7/1974 Krekler ..... A47L 11/4069 15/98

(Continued)

FOREIGN PATENT DOCUMENTS

CN 203234698 10/2013
DE 102006028035 A1 * 12/2007 ..... A47L 11/4041

(Continued)

OTHER PUBLICATIONS

International Search Report and Written Opinion dated Mar. 14, 2019 for International Application No. PCT/EP2018/081284 Filed Nov. 15, 2018.

(Continued)

*Primary Examiner* — Shay Karls

(57) ABSTRACT

A surface cleaning device comprises a brush (B) that is curved at least partially around a center part (CP) of the surface cleaning device, a deformability of the brush (B) determining a deformability of an outer circumference of the surface cleaning device. The brush (B) has a rotation axis (A), which is curved at least partially around the center part (CP) of the surface cleaning device. The rotation axis (A) is parallel to the surface. The brush (B) may be a donut-shaped brush (B) fully around the center part (CP) of the surface cleaning device. The surface cleaning device may have an electrical motor (M) for driving the brush (B). The center part (CP) may comprise a container (DC) for collecting dirt swept from the surface by the brush (B). The center part (CP) may have an edge (E) for bending the brush (B), dirt (Continued)

being released from the brush (B) at an end of the edge (E) where the brush (B) is relaxed. The center part (CP) may have an upper rim (R) for keeping the brush (B) at its position. A length of brush fibers from the rotation axis (A) of the brush (B) is preferably at least about 0.4, and more preferably at least about 0.6, times a radius of an undeformable core of the surface cleaning device. The surface cleaning device may further comprise a fan for generating an air flow that does not exceed 6 1/s, preferably 3 1/s, and more preferably 1.5 1/s.

18 Claims, 3 Drawing Sheets

(51) Int. Cl.
*A46B 13/00* (2006.01)
*A47L 9/04* (2006.01)

(56) References Cited

U.S. PATENT DOCUMENTS

| | | | | |
|---|---|---|---|---|
| 5,742,966 | A | 4/1998 | Tono | |
| 5,896,611 | A | 4/1999 | Haag | |
| 6,032,313 | A | 3/2000 | Tsang | |
| 7,591,039 | B2 * | 9/2009 | Kaleta | A47L 11/32 15/41.1 |
| 2007/0074358 | A1 * | 4/2007 | Tsai | A46B 7/10 15/42 |
| 2011/0138570 | A1 * | 6/2011 | Hsu | A47L 7/02 15/383 |
| 2013/0297079 | A1 * | 11/2013 | Tamminen | G05D 7/0629 700/276 |

FOREIGN PATENT DOCUMENTS

| | | |
|---|---|---|
| DE | 202016001757 | 6/2016 |
| DE | 102006028035 | 12/2017 |
| FR | 2927789 | 8/2009 |
| KR | 20100061915 A | 6/2010 |
| WO | 2007/144067 | 12/2007 |

OTHER PUBLICATIONS

Atesco Industrial Hygiene Ltd, Chenille Microfiber Overhead Pipe Duster (MF115353) https://atesco.ca/products/chenille-microfiber-overhead-pipe-duster-mf115353?_pos=1&_sid=b2132a980&_ss=r.

Microfiber Wholesale, Chenille Microfiber High Duster Cover https://www.microfiberwholesale.com/Chenille-Microfiber-High-Duster-Cover.html.

* cited by examiner

SURFACE CLEANING DEVICE

CROSS REFERENCE TO RELATED APPLICATIONS

This application is the U.S. National Phase application under 35 U.S.C. § 371 of International Application No. PCT/EP2018/081284 filed Nov. 15, 2018, published as WO 2019/101607 on May 31, 2019, which claims the benefit of European Patent Application Number 17203092.6 filed Nov. 22, 2017. These applications are hereby incorporated by reference herein.

BACKGROUND OF THE INVENTION

WO 2007/144067 discloses a floor sweeping device, in particular a carpet sweeper, with at least one brush roller which, during the sweeping process, rotates around an axis parallel to the floor to be swept, and which has at least three rotational sliders which, during the sweeping process, each rotate around their own axes, which are at 90-degree angles to the floor to be swept. The floor sweeping device can easily be guided across the surface to be swept in all directions. The floor sweeping device may have a polygon shape, e.g. a triangle or a square. An embodiment has a triangle shape having 3 rotational sliders at each corner, and 3 brush rollers between the corners. A driving motor propels primarily the brush rollers, and the propelled brush rollers propel the rotation sliders over a transmission, in particular a gear.

This known device has a sweeping brush that is positioned inside the housing, has relatively short fibers, and straight edges.

SUMMARY OF THE INVENTION

It is, inter alia, an object of the invention to provide a more flexible and less complex surface cleaning device. The invention is defined by the independent claims. Advantageous embodiments are defined in the dependent claims.

An aspect of the invention provides a surface cleaning device that comprises a brush that is curved (or bent) at least partially around a center part of the surface cleaning device, a deformability of the brush determining a deformability of an outer circumference of the surface cleaning device. The curved brush has a rotation axis at a center of a cross-section of the curved brush, which is curved at least partially around the center part of the surface cleaning device. The rotation axis is parallel to the surface.

The brush is advantageously curved fully around the center part of the surface cleaning device, which results in a substantially uninterrupted circumference of the appliance (interruptions may e.g. exist where the brush is fixed to the center part, e.g. where it is driven, and at any transitions between brush elements if the brush is constituted by multiple brush elements). If the surface cleaning device has a circular shape, the brush will be donut-shaped.

The surface cleaning device may have an electrical motor for driving the brush. The center part may comprise a container for collecting dirt swept from the surface by the brush. The center part may have an edge for bending brush filaments/tufts, dirt being released from the brush at an end of the edge where the brush filaments/tufts are relaxed. The center part may have an upper rim for keeping the brush at its position. A length of brush fibers from the rotation axis of the brush is preferably at least about 0.4, and more preferably at least about 0.6, times a radius of an undeformable core of the surface cleaning device, which results in a curved brush core with long tufts, so as to create a flexible and circular outer rim of the surface cleaning device, which allows for the surface cleaning device to be easily moved along and between objects. The surface cleaning device may further comprise a fan for generating an air flow that does not exceed 6 1/s, preferably 3 1/s, and more preferably 1.5 1/s.

Embodiments of the invention that feature a single donut-shaped brush provide the advantage that no transmission or gear is needed to ensure that another brush also rotates.

These and other aspects of the invention will be apparent from and elucidated with reference to the embodiments described hereinafter.

DESCRIPTION OF EMBODIMENTS

Embodiments provide an electric sweeper that cleans in every direction, for use in a robotic surface cleaner or a manual flexible cleaning device. By creating a circular surface unit with a rotating donut-shaped brush with microfiber 'fingers' around its perimeter, a fluent surface cleaning experience comparable to mopping is achieved. The donut-shaped brush continuously rotates and takes dirt inwards. This creates a fluent omnidirectional interaction, a fast and thorough cleaning performance around objects (e.g. chair legs), and a clean result in every direction the surface unit is used. Next to that, the whole perimeter of the surface unit is now soft, and does not damage furniture.

Figure 1:
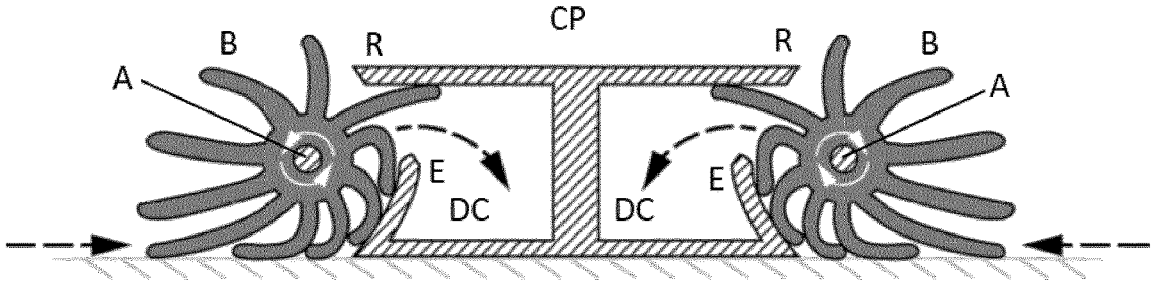
FIG. 1 shows a cross section of a first embodiment of a surface cleaning device in accordance with the invention.

FIG. 1 shows a cross section of a first embodiment of a surface cleaning device in accordance with the invention. This cross-section of the surface cleaning device shows two cross-sections of a single brush B that is curved around a center part CP of the surface cleaning device, which single brush B has a single axis A around the center part CP. The basic design of this first embodiment with a circular brush B around the center part CP can also be well understood from the top views of FIGS. 2-3 and 5-6.

Embodiments provide a chenille microfiber brush B, which is attached to a flexible axis A, for instance a pull spring, curved around a dirt container DC in the center part CP of the device. The chenille microfiber may e.g. be like the material used by the company Microfiber Wholesale (Riverside, Calif.) for their Chenille Microfiber High Duster Cover, or the material used by the company ATESCO Industrial Hygiene ltd for their Chenille Microfiber Overhead Pipe Duster (MF115353). The chenille fingers of the brush B are dragged over the surface, capturing the dirt, and releasing it into the dirt container DC, as shown in the cross-section of FIG. 1. The dirt container DC in the center part CP may be rigid. The bottom ramp to guide the dirt into the dirt container DC could be made slightly flexible (by adding bristles for instance) to maintain the flexible operation of the device. The center part CP has an edge E for bending the donut-shaped brush B, dirt being released from the donut-shaped brush B at an end of the edge E where the donut-shaped brush B is relaxed. The center part CP has an upper rim R for keeping the donut-shaped brush B at its position. The brush B does not have to be unfolded in the appliance itself. For instance, the appliance could be 60 mm high, while the brush B has a diameter of 80 mm. The brush B can still fit inside the center part CP, since the brush B can deform when it enters the center part CP, and expand when it leaves the center part CP.

The core of the brush B is preferably made of a flexible material. In an embodiment, the core of the brush B is made of a helical tension spring, since a helical tension spring possesses lots of bending flexibility, while still being rigid in torsional direction. In an embodiment, the spring used has the following dimensions: spring diameter 6 mm, wire diameter 0.8 mm. Different springs can be used, as long as they are sufficiently flexible in bending direction and able to withstand the torque needed. A bending stiffness of not more than 15 Nm/rad would do, while a bending stiffness of not more than 1.5 Nm/rad would be better, and an even smaller bending stiffness of not more than 0.15 Nm/rad would be preferred. As regards core torque resistance: the brush must be able to withstand the torque exerted by the brush. Flexible cores have the tendency to curl up under torque. The inventors have determined that at a maximum torque Tmax of about 1.5 Nm, the core should remain stable (i.e. not curl up as a result of a too high torque).

The cleaning finger elements can be stitched to a fabric backing, which can be in turn wrapped around the spring that is used as the axis A. The core is connected directly to the body at the drive axis. A drive axis can be connected at both sides (closing the circle). In an embodiment, the brush B is held in place by its housing, i.e. by the upper rim R of the center part CP. Another option to keep the brush in place, also during lifting, is by means of bearing plates (perpendicular to the local rotation vector of the brush core), in which a bearing hole is made, which cooperates with a bearing element on the core. The system seems to have the best perceived performance when the brush elements are very flexible and have some volume. A suitable material is microfiber, which is stitched into finger-like elements. It is also possible to use feather duster-like materials. Many microfiber materials are made from polyester.

Figure 2:
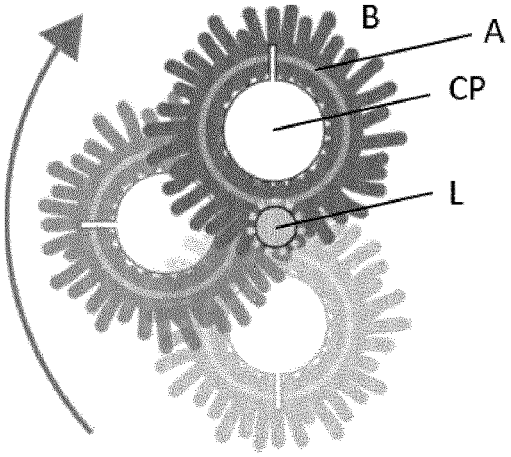
FIG. 2 illustrates how the first embodiment can be moved around a chair leg or table leg.
Figure 3A:
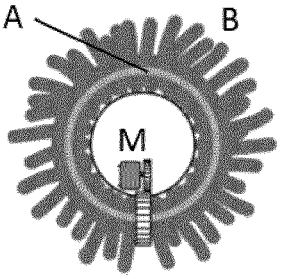
FIGS. 3A-3D show various possibilities of how a motor can drive a rotating donut-shaped brush of the first embodiment.
Figure 3B:
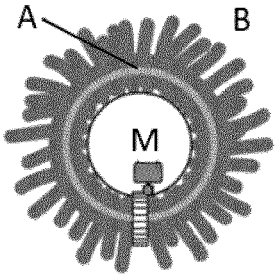
Figure 3C:
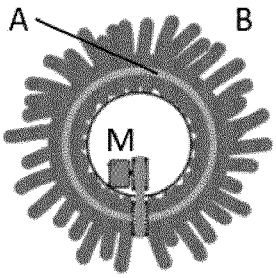
Figure 3D:
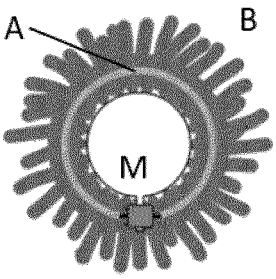

The rotating chenille fibers can easily clean around a chair leg/table leg L by simply moving the unit around from one side, as shown in FIG. 2.

The brush axis A is driven by an electric motor M, as found in normal electric sweepers. The power can be transferred to the axis A by a chain or belt drive or gears, see FIGS. 3A-3C. Alternatively, the electric motor M could be placed in line with the flexible axis A and covered by the hairs of the brush B, see FIG. 3D.

Figure 4A:
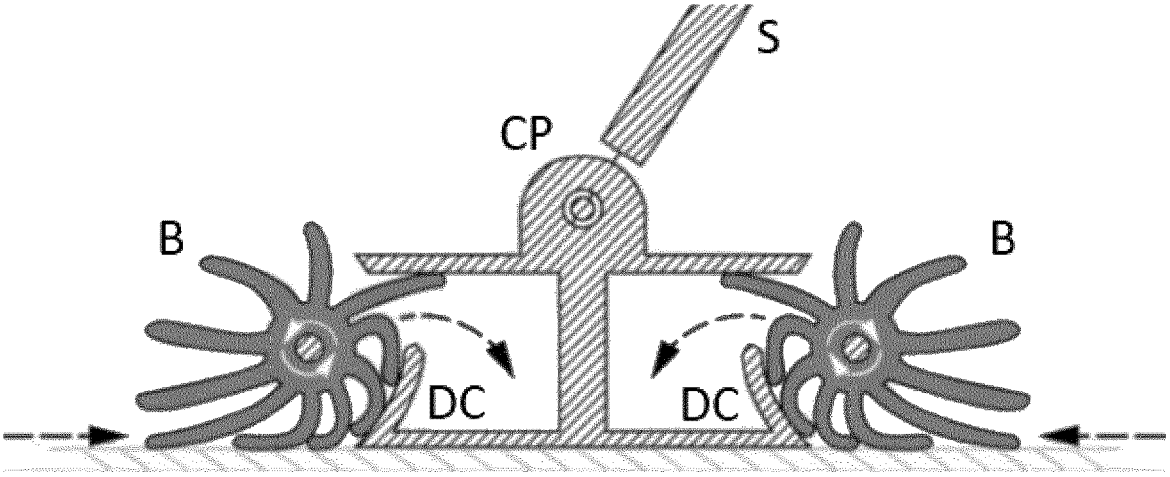
FIGS. 4A-4B show embodiments of a manually moved surface cleaning device and a robot surface cleaning device in accordance with the invention.
Figure 4B:
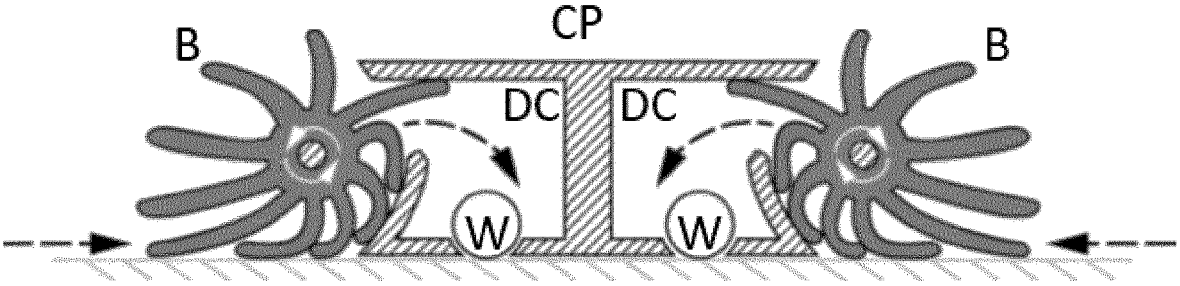

The invention can be applied in both cleaning robots and flexible cleaning appliances. For flexible cleaning appliances, there would be a universal joint with rotational freedom in the XY plane (like the well-known cardan joint) and a stick S on top of the surface module, as shown in FIG. 4A. By having a rotating hinge, e.g. provided with bearings, the unit can easily roll around a chair leg L, as shown in FIG. 2. In a cleaning robot, the drivetrain and wheels W would be placed in the center part CP of the unit, at the bottom of the dirt container DC, as shown in FIG. 4B.

Figure 5:
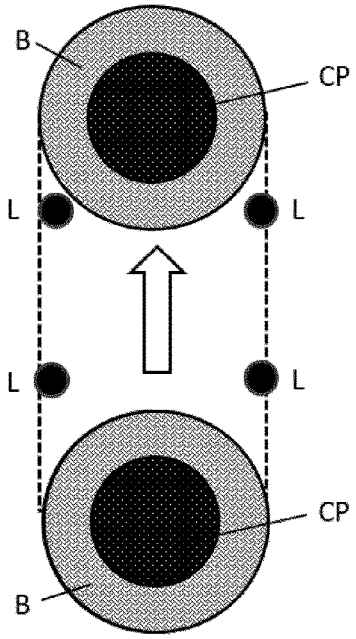
FIG. 5 illustrates how an embodiment of the invention can move between chair legs and table legs spaced apart at a smaller distance than the outer circumference of the circular brush.

FIG. 5 illustrates how an embodiment of the invention can move between chair legs and table legs L spaced apart at a smaller distance than the outer circumference of the donut-shaped brush B. Depending on the flexibility of the axis A (e.g. a helical spring is flexible), the device is still being able to clean between legs L spaced part at a distance less than the diameter of the axis A around the center part CP, but obviously the device cannot move between legs L spaced apart at a distance smaller than the diameter of the center part CP.

Figure 6:
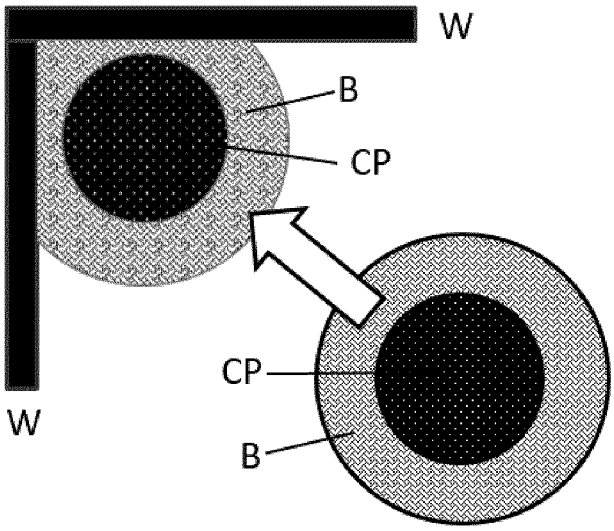
FIG. 6 illustrates how the donut-shaped brush is able to clean corners of a room.

FIG. 6 illustrates how the donut-shaped brush B is able to clean corners of a room having walls W. To this end, the donut-shaped brush B needs to have hairs that are sufficiently long to reach the corner when the brush is pushed into the corner. In particular, Rbrush≥0.414*Rnozzle, in which Rbrush is the length of the brush hairs, and Rnozzle is the radius of the hard undeformable center of the device.

Rnozzle is the radius of the center part CP if the brush axis A is flexible, and the radius of the brush axis A if the brush axis A is hard to deform.

To really clean to the surface, the fibers should even be longer, so as to enable the brush fibers to reach into the corner at surface level:

Rbrush≥0.586*Rnozzle.

Figure 7:
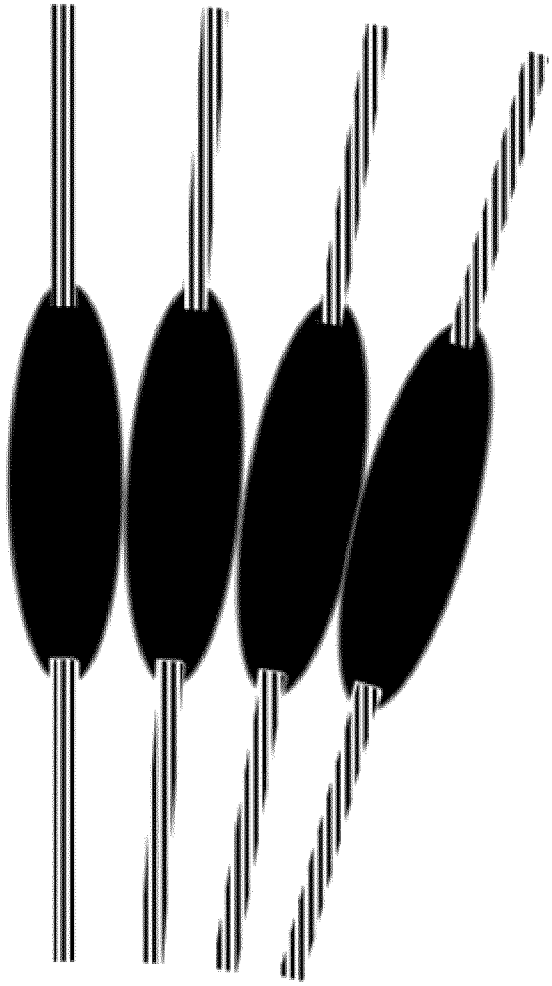
FIG. 7 illustrates part of an alternative donut-shaped brush.

FIG. 7 illustrates part of an alternative donut-shaped brush, in which the brush core is made from multiple (e.g. at least 20, and preferably at least 30) stiff center elements, which interact as shackles, each shackle having its own brush elements. The more shackles there are, the more flexible the brush will be.

An embodiment can clean the surface with just 9 V*2.1 A=19 W of input power. The circular brush uses more power than a straight one, but 19 W is still a really small amount compared to stick vacuum cleaners that usually consume about 140 W. In this advantageous embodiment, no suction power is needed. In an embodiment, the rotation speed can be quite low: 200 rpm (revolutions per minute) seems enough. During walking and cleaning, the speed of the microfiber dragging over the surface should be slightly larger than the speed of with the surface cleaning device is moved over the surface.

The cleaning task of the surface cleaning device in accordance with the present invention may advantageously be carried out by just having the rotating curved brush B. This results in a solution that only requires a minimal amount of energy, so that a small battery suffices, or that it is easily possible to clean relatively large areas without having to recharge the battery. However, to address the problem that just brushing the surface may create a small dust cloud in the process when fine dust is involved, a small fan and an optional filter may be added. This will create a small inward airflow, to prevent the dust cloud from occurring. This will significantly add to the perceived performance of the appliance. Some values: normal battery powered stick vacuum cleaners create an air flow of about 15 1/s. Robot vacuum cleaners create an air flow of about 6 1/s, which is a good starting point. More preferred is an air flow that does not exceed 3 1/s, since the lower the air flow, the less sound is generated and the smaller the filter can be. The most preferred air flow does not exceed 1.5 1/s since with that flow, even a HEPA-like filter can be constructed small while the device would be powered with a relatively small fan that only consumes small amounts of energy. Also when a fan is present, dust is preferably collected in the center part CP, e.g. like it is done in a robot vacuum cleaner.

It should be noted that the above-mentioned embodiments illustrate rather than limit the invention, and that those skilled in the art will be able to design many alternative embodiments without departing from the scope of the appended claims. For example, the donut-shaped brush B may be not a full donut but just a curved brush that is only partially around the center part CP. The brush B does not need to have the shape of a (partial) circle around the center part CP, but may have the shape of a (partial) oval around the center part CP, which center part CP then likewise has a circumference that is at least partially in the form of an oval, and the expression "(partially) around" should thus not be interpreted as implying a (partial) circle shape. Other alternative embodiments may have multiple donut-shaped brushes arranged e.g. like the shaver heads in a 2-headed or 3-headed rotary shaver. The rotation axis A does not have to be 100% parallel to the surface to be cleaned; it may be at a slight angle with regard to that surface. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention may be implemented by means of hardware comprising several distinct elements. In the device claim enumerating several means, several of these means may be embodied by one and the same item of hardware. The mere fact that certain measures are recited in mutually different dependent claims that do not refer to one another does not indicate that a combination of these measures cannot be used to advantage.

The invention claimed is:

1. A surface cleaning device for cleaning a surface, the surface cleaning device comprising:

a brush comprising tufts or filaments and a core comprising a flexible material and a helical tension spring, the brush having a rotation axis at a center of a cross-section of the brush and substantially parallel to the surface, wherein the helical tension spring has a bending stiffness between 15 Nm/rad and 0.15 Nm/rad or less; and a center part comprising an edge for bending filaments or tufts of the brush, dirt being released from the brush at an end of the edge where the filaments or tufts of the brush are relaxed, the brush being curved at least partially around the center part of the surface cleaning device, and the rotation axis being curved at least partially around the center part of the surface cleaning device.

2. The surface cleaning device as claimed in claim 1, wherein the brush is curved fully around the center part of the surface cleaning device.

3. The surface cleaning device as claimed in claim 1, wherein the center part comprises a container for collecting dirt swept from the surface by the brush.

4. The surface cleaning device as claimed in claim 1, wherein the center part comprises an upper rim for keeping the brush at its position.

5. The surface cleaning device as claimed in claim 1, wherein a length of brush fibers from the rotation axis of the brush is at least about 0.4, and preferably at least about 0.6, times a radius of an undeformable core of the surface cleaning device.

6. The surface cleaning device as claimed in claim 1, further comprising a fan for generating an air flow that does not exceed 6 1/s, preferably not more than 3 1/s, and more preferably not more than 1.5 1/s.

7. The surface cleaning device as claimed in claim 1, wherein the brush comprises chenille fibers.

8. The surface cleaning device as claimed in claim 1, wherein a diameter of the brush is greater than a height of the center part.

9. A surface cleaning device for cleaning a surface, the surface cleaning device comprising:

a brush having a flexible axis at a center of a cross-section of the brush and substantially parallel to the surface, the brush being curved at least partially around a center part of the surface cleaning device, and the flexible axis being curved at least partially around the center part of the surface cleaning device, wherein a deformability of the brush determines a deformability of an outer circumference of the surface cleaning device; and an electric motor disposed in line with the flexible axis and covered by filaments or tufts of the brush.

10. The surface cleaning device as claimed in claim 9, wherein the brush is curved fully around the center part of the surface cleaning device.

11. The surface cleaning device as claimed in claim 9, wherein the center part comprises a container for collecting dirt swept from the surface by the brush.

12. The surface cleaning device as claimed in claim 9, wherein the center part has an edge for bending filaments or tufts of the brush, dirt being released from the brush at an end of the edge where the filaments or tufts of the brush are relaxed.

13. The surface cleaning device as claimed in claim 9, wherein the center part comprises an upper rim for keeping the brush at its position.

14. The surface cleaning device as claimed in claim 9, wherein the brush comprises a core comprising a helical tension spring.

15. The surface cleaning device as claimed in claim 14, wherein the helical tension spring has a bending stiffness between 15 Nm/rad and 0.15 Nm/rad or less.

16. The surface cleaning device as claimed in claim 9, wherein the brush comprises chenille fibers.

17. The surface cleaning device as claimed in claim 9, further comprising a fan for generating an air flow that does not exceed 6 1/s, preferably not more than 3 1/s, and more preferably not more than 1.5 1/s.

18. The surface cleaning device as claimed in claim 9, wherein the brush comprises a core comprising a flexible material.

* * * * *